United States Patent [19]

Vaughn

[11] 4,042,174

[45] Aug. 16, 1977

[54] NOZZLE ADAPTER

[76] Inventor: Alvie G. Vaughn, R.R. No. 1, Osgood Road, Mendon, Mich. 49072

[21] Appl. No.: 697,854

[22] Filed: June 21, 1976

[51] Int. Cl.[2] ..... B05B 3/02

[52] U.S. Cl. ..... 239/286; 239/391; 239/600

[58] Field of Search ..... 239/178, 390, 391, 589, 239/596, 600, 601, 602, 286

[56] References Cited

U.S. PATENT DOCUMENTS

| | | | |
|---|---|---|---|
| 28,694 | 6/1860 | Smith | 239/600 X |
| 259,131 | 6/1882 | Gould | 239/391 |
| 2,225,521 | 12/1940 | Holveck | 239/600 |
| 2,277,811 | 3/1942 | Ashley et al. | 239/391 X |
| 2,308,992 | 1/1943 | Mertens | 239/391 X |
| 2,330,034 | 9/1943 | Doodchenko | 239/391 X |
| 2,474,071 | 6/1949 | Stetson | 239/178 |
| 2,792,671 | 5/1957 | Sprigg et al. | 239/600 X |
| 3,779,462 | 12/1973 | Bruninga | 239/390 X |
| 3,799,453 | 3/1974 | Hart | 239/391 X |

FOREIGN PATENT DOCUMENTS

| | | | |
|---|---|---|---|
| 463,476 | 2/1914 | France | 239/391 X |

*Primary Examiner*—Johnny D. Cherry
*Assistant Examiner*—Andres Kashnikow
*Attorney, Agent, or Firm*—Blanchard, Flynn, Thiel, Boutell & Tanis

[57] ABSTRACT

A nozzle assembly for an irrigation apparatus having a conical nozzle body mountable on the discharge pipe of the irrigation apparatus. The nozzle assembly is also provided with a set of interchangeable tip members of different sizes to permit variation in the flow rate of the nozzle assembly. The flow passages through the individual tip members are of uniform slope with the nozzle body, and the discharge orifices in the tip members are formed directly at the free ends thereof, to ensure that the discharged stream is properly broken up and uniformly dispersed over the irrigation area.

1 Claim, 5 Drawing Figures

FIG. 1
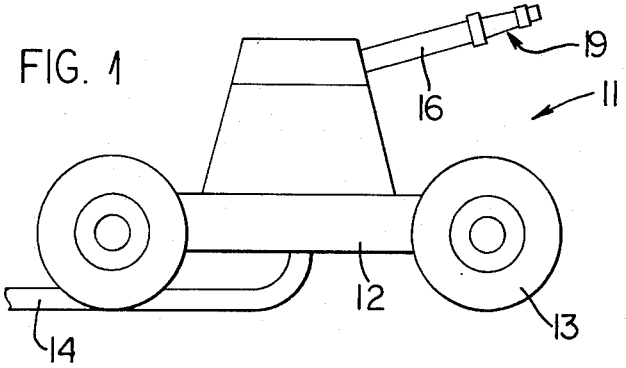
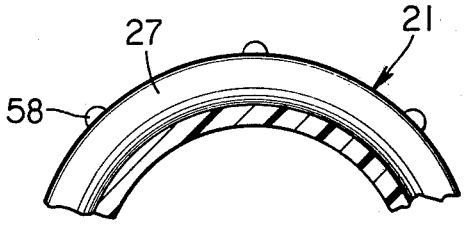
FIG. 3
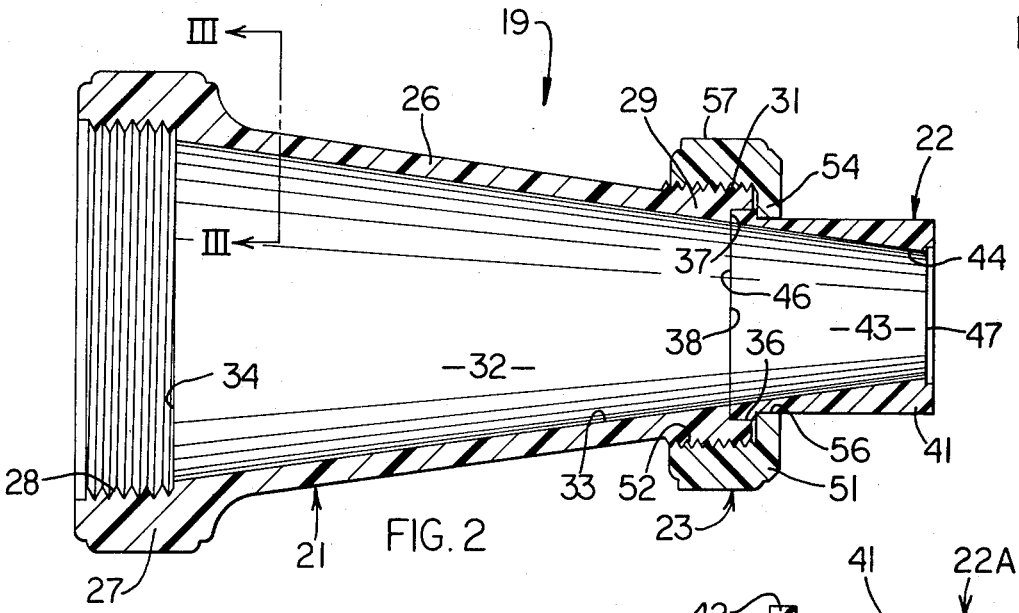
FIG. 2
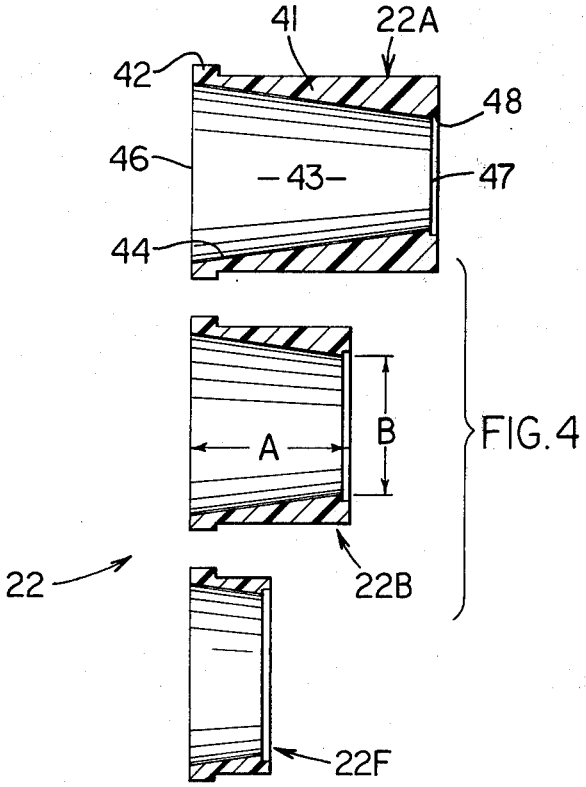
FIG. 4
| TIP | B (DIA) | A (LENGTH) |
|---|---|---|
| 22A | 1.000 | 2.134 |
| 22B | 1.100 | 1.779 |
| 22C | 1.200 | 1.423 |
| 22D | 1.300 | 1.067 |
| 22E | 1.400 | .711 |
| 22F | 1.500 | .356 |
FIG. 5

NOZZLE ADAPTER

FIELD OF THE INVENTION

This invention relates to an improved nozzle assembly for use on an irrigation apparatus and, in particular, to a nozzle assembly having a set of interchangeable tip members for permitting the flow rate through the nozzle assembly to be easily selectively varied.

BACKGROUND OF THE INVENTION

Agricultural irrigation devices are widely utilized for crop irrigation. These irrigation devices normally employ a discharge pipe having a nozzle associated therewith for throwing a stream of water over a field containing a growing crop. To provide the grower with an opportunity to vary the quantity of water, these irrigation devices have sometimes been provided with a set of interchangeable washers which function as discharge orifices for controlling the flow rate through the nozzle. However, systems of this type have proven less than satisfactory since the washer creates a substantial disturbance on the discharged stream of water, whereby the stream does not properly break up, both in terms of particle size and uniformity of dispersion over the irrigation area. These known irrigation nozzles have accordingly not resulted in the necessary uniformity of irrigation, and have often resulted in undesired crop damage.

Accordingly, it is an object of the present invention to provide an improved nozzle assembly for use on an agricultural irrigation apparatus, which nozzle assembly overcomes the above-mentioned shortcomings.

Specifically, it is an object of the present invention to provide an improved nozzle assembly which has a conical nozzle body mountable on the discharge pipe of the irrigation apparatus, which nozzle assembly is also provided with a set of interchangeable tip members of different sizes to permit variation in the flow rate of the nozzle assembly. The individual tip members are all of uniform slope with the nozzle body and have the discharge orifices formed directly at the free ends thereof to ensure that the discharged stream is properly broken up and uniformly dispersed over the irrigation area.

Another object of the invention is the provision of a nozzle assembly, as aforesaid, which can be manufactured in an economical manner, which can be purchased by a grower with minimum cost, which can be readily interchanged while the irrigation apparatus is assembled in the field to provide the desired flow rate, which is of small and compact size, and which provides the grower with a substantially larger selection of different yet relatively similar flow rates so that the grower can provide optimum irrigation.

While it is recognized that nozzle assemblies having removable tip members are well known, as shown in U.S. Pat. Nos. 3,799,453 and 2,225,521, for example, nevertheless none of the known nozzle assemblies employing removable tip members have possessed the features necessary for use on an agricultural irrigation apparatus.

For example, the nozzle assembly shown in above-mentioned U.S. Pat. No. 3,799,453 discloses a tip member wherein the conical flow opening terminates in a discharge orifice which is spaced inwardly a substantial distance from the end face of the tip member, whereby the discharge orifice communicates with a uniform-diameter cylindrical flow passage. This cylindrical flow passage thus acts as a restriction which disrupts the proper discharge of fluid from the nozzle assembly and accordingly prevents the fluid from having the desired breakup and dispersion uniformity necessary for agricultural irrigation. In addition, the nozzle assembly of this patent is designed for use on an irrigation device of the type used for residential purposes, as for sprinkling lawns. Thus, it is not suitable for agricultural irrigation where the discharged stream must be thrown extremely long distances while at the same time provide the desired breakup and uniform dispersion of the water so as to uniformly irrigate the desired area without damaging the crop.

The improved nozzle assembly of the present invention will now be described with reference to the accompanying drawings.

BRIEF DESCRIPTION OF THE DRAWINGS

FIG. 1 diagrammatically illustrates a conventional irrigation apparatus with which the improved nozzle assembly of the present invention is adapted for use.

FIG. 2 is an enlarged sectional view of the nozzle assembly according to the present invention.

FIG. 3 is a fragmentary sectional view along line III—III in FIG. 2.

FIG. 4 illustrates, in cross-section, some of the tip members which form the set.

FIG. 5 is a chart illustrating the sizes of the different tip members forming the set.

DETAILED DESCRIPTION

Referring to FIG. 1, there is diagrammatically illustrated a conventional irrigation apparatus 11 formed by a frame 12 supported by a plurality of wheels 13 so that the apparatus can be rollingly moved along a field. A large diameter discharge pipe 16 is supported on the frame for swiveling movement about a substantially vertical axis, which discharge pipe is connected to a trailing supply hose 14. The irrigation apparatus 11 is adapted to be slowly moved through a field, either by a water-type reaction drive system, or by being pulled through the field by a cable stretched between the irrigation apparatus and a tractor. As the apparatus is displaced through the field, the discharge pipe is slowly moved through a substantial angular extent, such as 300°, and is then rapidly returned to its starting position to initiate a further sweeping action. The structure and operation of the irrigation apparatus 11 is conventional, and further description of same is not believed necessary.

To control the discharge of water from the pipe 16, there is provided a discharge nozzle mounted on the free or discharge end thereof. According to the present invention, the end of pipe 16 is provided with the improved discharge nozzle assembly 19 mounted thereon.

Referring to FIGS. 2–4, the nozzle assembly 19 includes a nozzle body 21 which is mountable on the end of the discharge pipe 16. A set of interchangeable tip members 22 is provided for permitting the flow rate through the nozzle assembly to be selectively varied. The set of tip members 22 contains a plurality of different tip members which can be individually interchangeably mounted on the nozzle body 21, as by means of a nut 23. In the illustrated embodiment, the set 22 contains six tip members of different sizes, which tip members have been designated as 22A through 22F in the chart of FIG. 5. The individual tip members 22A, 22B and 22F are shown in FIG. 4 for purposes of illustration.

Considering the body member 21, same is formed by an elongated sleeve member 26 which is of a substantially truncated conical configuration and is thus of substantially uniform wall thickness throughout the length thereof. Sleeve member 26 terminates in an enlarged cylindrical portion 27 at the rearward or large end thereof, which portion 27 has an internally threaded bore 28 for permitting the nozzle body to be threadably mounted on the discharge end of the pipe 16. The forward or small end of the sleeve member 26 also has a cylindrical portion 29 formed thereon, which portion has an external thread 31 adapted for cooperation with the nut 23.

A conically-shaped flow passage 32 extends axially through the sleeve member 25, being defined by the interior conical wall 33. The wall 33 is of a substantially uniform slope, which slope is in the order of between 6° and 10°, being 8° in the illustrated embodiment. Passage 32 terminates in an inlet opening 34 at the large end of the nozzle body, which inlet opening 34 is of a diameter substantially equal to the bore with the discharge pipe 16.

The small diameter end of nozzle body 21 has an annular recess 36 formed therein, which recess surrounds the flow passage 32. Recess 36 extends axially inwardly from the end face of the nozzle body and terminates in a seating surface 37 whch is substantially perpendicular to the axis of the body. Seating surface 37, where it intersects the conical wall 33, defines a discharge opening 38 at the small end of the nozzle body.

Considering now the set of tip members 22, a typical tip member 22A will be described.

Tip member 22A comprised a cylindrical body member 41 has an enlarged annular flange 42 projecting radially outwardly from the rearward end of the body member. Flange 42 has an external diameter so that it can be snugly seated within the recess 36 formed in the nozzle body 21. The cylindrical body member 41 has a converging conical flow passage 43 extending axially therethrough, as defined by the interior conical surface 44. The slope of passage 43, as defined by conical surface 44, is identical to the slope of the flow passage 32 formed in the nozzle body. The flow passage 43 has an inlet orifice 46 formed at the large diameter end thereof, which inlet orifice 46 has a diameter thereof equal to that of the discharge opening 38 formed in the nozzle body. Thus, inasmuch as the openings 38 and 46 of identical diameter, and since the flow passages 32 and 43 are of identical slope, this results in a continuous passage formed by the nozzle body and the tip member to provide for continuous and uninterrupted flow through the nozzle assembly. This identity of slope in both the nozzle body and tip member thus ensures that the most efficient flow of fluid occurs through the nozzle assembly.

The discharge end of tip member 22A has a discharge orifice 47 formed therein, which orifice is effectively located at the free end of the tip member so that the exterior space surrounding this discharge orifice 47 is completely free and unobstructed, thereby permitting the desired discharge of a liquid stream from the nozzle assembly. As illustrated in FIG. 4, a shallow recess 48 is preferably provided in the end face of the tip member in surrounding relationship to the discharge orifice 47 so as to prevent damage or chipping of this edge during handling of the tip member.

As is well known by those familiar with nozzles, the diameter of the discharge orifice 47 determines the quantity of liquid which can be discharged through the nozzle assembly, so long as the other conditions, specifically supply pressure, remain the same.

The other numbers of the set 22 are identical to the tip member 22A, described above, except for the dimensions A and B. As illustrated in FIG. 4, the dimension A designates the axial length of the individual tip members, whereas the dimension B designates the diameter of the discharge orifice 47. The tip members of set 22 are of progressively different sizes as represented by the dimensions A and B which are illustratively set forth in the chart of FIG. 5. By progressively shortening the overall axial length A of the tip members 22A through 22F, this thus results in the diameter B of the discharge orifices 47 progressively increasing. Thus, by selecting the appropriate tip member 22A through 22F, as by selecting the tip member having the desired diameter B of the discharge orifice 47, the desired discharge rate can be appropriately selected.

The individual tip members are mounted on the body member by the nut 23 which, as shown in FIG. 2, comprises a ringlike body 51 having a bore 52 formed therein, which bore is threaded so as to be threadably engaged with the thread 31 formed on the small end of the nozzle body. The ring-shaped body 51 has an inwardly projecting annular flange 54 adjacent one axial end thereof, which flange 54 defines an internal opening 56 which is of a diameter slightly larger than the exterior diameter of the cylindrical body member 41. This opening 56 thus accommodates therein the cylindrical body member 41, with the flange 54 radially overlapping the flange 42 so as to clampingly hold the flange 42 between the flange 54 and the seating surface 37. The axial thickness of flange 42 is preferably slightly greater than the axial depth of recess 34 so as to ensure a tight sealed relationship between the tip member and the nozzle body.

To facilitate manual gripping and turning of the nut 23, the external peripheral surface thereof is preferably provided with suitable gripping means thereon, such as the ribs 57.

Similar gripping ribs 58 are also provided on the external surface of the cylindrical portion 27 at the large end of the nozzle body.

The components of the nozzle assembly, including the nozzle body 21, the nut 23 and the individual tip members 22A–22F are all preferably molded from a hard and durable plastic material. For example, the nozzle body and nut are preferably molded from Celcon (Trademark) and the tip members are preferably molded from Delrin (Trademark).

OPERATION

In operation, the nozzle body 21 is threadably mounted on the end of the discharge pipe 16, which pipe is normally about three inches in diameter. One of the tip members forming the set 22, such as the tip member 22A, is selected in accordance with the desired flow rate necessary for irrigation. This tip member is inserted through the opening formed in the nut 23, which nut is then threaded onto the end of the nozzle body, substantially as illustrated in FIG. 2, to thereby securely and sealingly mount the tip member onto the nozzle body. The overall nozzle assembly thus has a continuous flow passage of uniform slope therethrough, which flow passage is free of disruptions or other flow disturbing features.

Thus, the irrigation apparatus is in a condition for utilization. Pressurized water (80 to 90 pounds pressure) is then supplied to the discharge pipe 16 and flows through the nozzle assembly 19, whereupon the discharged stream of water is thrown through a distance of between 180 and 200 feet for irrigating the selected areas of a field. Due to the uniform slope of the nozzle assembly, and due to the discharge orifice 47 being formed directly at the free end of the tip member, this results in the discharged stream of water being broken up into water particles of relatively consistent size with the particles being distributed rather uniformly over the area being irrigated. This uniform breakup and distribution of the water is essential to not only provide proper irrigation of the field, but to also prevent damage to the crop.

In the illustrated embodiment, the set 22 includes six different tip members of progressively increasing size as defined by the diameters of the discharge orifice 47, which sizes are listed in the chart of FIG. 5. However, the nozzle assembly of the present invention provides still an additional discharge orifice since the diameter of the discharge opening 38 formed in the body member 21 is one step larger than the largest diameter of the discharge orifice 47, such as is represented by the tip member 22F having a discharge orifice with a diameter of 1.500 inches. By making the discharge opening 38 with a diameter of 1.600 inches, this opening can itself be utilized as a discharge orifice so that the nozzle body can thus be utilized for providing still a larger flow rate through the nozzle assembly merely by leaving off the tip member.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In an agricultural irrigation apparatus having a wheeled frame, a water discharge pipe swingably supported on said frame for substantially horizontal angular displacement, and nozzle means mounted on the discharge end of said discharge pipe, the improvement wherein said nozzle means comprises:

a tapered elongated one-piece sleevelike nozzle body having thread means associated with the large diameter end thereof for threadably attaching said nozzle body to said discharge pipe, said nozzle body having an elongated flow passage extending therethrough which is of a truncated conical configuration, said flow passage having a large diameter inlet opening at the rearward end thereof which is of a diameter substantially equal to the diameter at the discharge end of said discharge pipe, said flow passage having a smaller diameter discharge opening at the other end thereof, said flow passage being of uniform slope as it extends between said inlet and discharge openings, said nozzle body also having a shallow annular recess extending inwardly from the small diameter end thereof in surrounding relationship to said discharge opening so that said recess forms a substantially annular seating surface which is within a plane substantially perpendicular to the axis of said nozzle body;

said nozzle body being of substantially uniform radial wall thickness throughout the circumferential and axially extending length thereof except for enlarged cylindrical portions formed at the large and small ends thereof, the enlarged cylindrical portion at the large end of said nozzle body being internally threaded for receiving therein the discharge end of said discharge pipe, and the cylindrical portion at the small end of said nozzle body being externally threaded;

a plurality of tip members each of different size, said tip members being individually interchangeably mountable on the small diameter end of said nozzle body;

each said tip member comprising a substantially cylindrical one-piece body member having an enlarged annular flange at one end thereof, said flange being of a size compatible with the recess formed in the small diameter end of said nozzle body, each said tip member also having a flow passage extending axially therethrough, said flow passage being of a truncated conical configuration and having an inlet orifice at one end of said cylindrical body which is of a diameter equal to the discharge opening formed in said nozzle body, each said tip member also having a discharge orifice formed at the other end thereof which is of a substantially smaller diameter than said inlet orifice, said discharge orifice being located directly in the axial end face of said cylindrical body as defined at said other end, and said flow passage being of uniform slope as it extends between said inlet and discharge orifices, the slope of the flow passage in said tip member being identical to the slope of the flow passage in said nozzle body;

said plurality of tip members being identical except for each tip member being of different axial length from all of the other tip members so that each tip member of said plurality has a different diameter discharge orifice, the cylindrical body forming each said tip member being of substantially uniform external diameter throughout the axial length thereof except for said annular flange which projects radially outwardly from said cylindrical body at said one end thereof, the discharge orifices defined by said plurality of tip members being of progressively increasing diameters so that the difference between the discharge orifices of the adjacent sizes of tip members is thus a preselected differential amount, the length of said plurality of tip members progressively decreasing as the diameters of the respective discharge orifices progressively increase, and the diameter of the discharge opening formed in said nozzle body being larger than the largest discharge orifice by said preselected differential amount, whereby said discharge opening can itself be utilized as a discharge orifice when a tip member is not mounted on said nozzle body; and an annular one-piece nut encircling and being threadably connected to the externally threaded cylindrical portion at the small diameter end of said nozzle body, said nut having an annular flange which projects radially inwardly so as to overlap the axial end face of said nozzle body at the small end thereof, the flange on said nut also projecting radially inwardly so as to overlap the annular flange on each of said tip members for fixedly holding the flange on a selected tip member in snug bearing engagement with the seating surface on said nozzle body.

* * * * *